United States Patent [19]

Matsuda et al.

[11] 4,191,863

[45] Mar. 4, 1980

[54] SUPPORT FOR MULTI-POINT MAGNETIC DRIVER LOUDSPEAKER

[75] Inventors: Atsushi Matsuda, Tokyo; Jun Kishigami, Urawa, both of Japan

[73] Assignee: Sony Corporation, Tokyo, Japan

[21] Appl. No.: 963,903

[22] Filed: Nov. 27, 1978

[30] Foreign Application Priority Data

Nov. 26, 1977 [JP] Japan ..... 52-141852

[51] Int. Cl.[2] ..... H04R 9/06

[52] U.S. Cl. ..... 179/115.5 R

[58] Field of Search ..... 179/114 R, 114 A, 115 R, 179/115 A, 115.5 R, 115.5 DV

[56] References Cited

U.S. PATENT DOCUMENTS

| | | | |
|---|---|---|---|
| 1,872,799 | 8/1932 | Pare | 179/115.5 R |
| 3,351,719 | 11/1967 | Schoengold | 179/115.5 R |

FOREIGN PATENT DOCUMENTS

| | | | |
|---|---|---|---|
| 9838 | of 1927 | Australia | 179/115.5 R |
| 312756 | 6/1929 | United Kingdom | 179/115.5 R |

*Primary Examiner*—George G. Stellar

*Attorney, Agent, or Firm*—Lewis H. Eslinger; Alvin Sinderbrand

[57] ABSTRACT

A dynamic loudspeaker of the plane vibrating-plate, multi-point drive type has a support structure in the rear of the plane plate or diaphragm supporting the forward ends of a plurality of magnetic drivers to a frame. Connecting arms and diagonal connecting arms in the support structure stiffen the support structure to reduce vibration-induced flexure. The rear most ends of the magnetic drivers are also braced together and a transverse brace is connected between the structures at the forward and rear ends of the magnetic drivers.

11 Claims, 4 Drawing Figures

SUPPORT FOR MULTI-POINT MAGNETIC DRIVER LOUDSPEAKER

BACKGROUND OF THE INVENTION

1. Field of the Invention

This invention relates generally to dynamic speakers of the plane vibrating-plate, multi-point drive type and, more particularly, is directed to apparatus for supporting the driving mechanism for such a dynamic speaker.

2. Description of the Prior Art

In a dynamic speaker of the plane vibrating-plate or diaphragm type which employs a plurality of magnetic circuits driving a substantially square vibrating plate or diaphragm at a plurality, preferably four, attachment points along diagonals of the square plate, it is important for fidelity of reproduction that the rear surface of the vibrating plate be relatively open to the air. Without a substantial degree of openness, the free movement of the vibrating element or diaphragm is interfered with and the frequency of the dynamic speaker is degraded.

The applicants have discovered that the openness at the rear of the vibrating element is preferably at least 60 percent and that any substantial decrease in openness at the rear of the vibrating element deteriorates the frequency responsive characteristics of the loudspeaker.

Flat-plate loudspeakers of the type described require substantial rigidity in the frame structure which supports the plate-like diaphragm and the magnetic driving elements. The requirement for rigidity limits the amount of openness which can be achieved in the existing rear support structures. The difficulty in providing the requisite openness is further complicated by the fact that the plurality of magnetic driving circuits, themselves, occupy a significant portion of the area opposed to the rear of the vibrating plate-like diaphragm.

Dynamic speakers of the type discussed herein are disclosed in U.S. Pat. No. 4,122,314. As disclosed in the referenced patent, four magnetic driving circuits are disposed at the rear of the flat plate diaphragm and are held in place by a die-cast framework having arms parallel to the sides of the speaker. When installed as described in the referenced patent, the magnetic driving circuits couple the reaction forces from driving the diaphragm back into the support structure and, the support structure is thereby subjected to vibratory movement which interferes with reproduction fidelity.

OBJECTS AND SUMMARY OF THE INVENTION

It is the object of the present invention to provide a flat plate speaker which avoids the difficulties encountered with the prior art.

More particularly, an object of this invention is to provide a flat plate speaker employing multi-point drive of the flat plate-like diaphragm mounted in a frame supporting the magnetic driving elements with maximum openness toward the rear and in which structural deflections of the frame structure are minimized.

In a speaker according to the invention, box-type bracing is employed between the magnetic driving elements, and sets of diagonal brace elements connect pairs of magnetic driving members together in a front plane nearer the diaphragm and in a rear plane at the ends of the magnetic driving element remote from the diaphragm. The diagonal reinforcing or brace elements are further braced by a rod connecting together the centers of the forward and rear sets of diagonal brace elements.

The bracing structure is further strengthened by flexing the rear set of diagonal brace elements at the center thereof by placing the connecting rod in tension. This reduces the tendency for the forward and rear sets of diagonal brace elements to vibrate in the fashion of a limber rod.

The above, and other objects, features and advantages of the invention, will be apparent in the following detailed description of an illustrative embodiment of the invention which is to be read in connection with the accompanying drawings.

DETAILED DESCRIPTION OF THE PREFERRED EMBODIMENT

Figure 1:
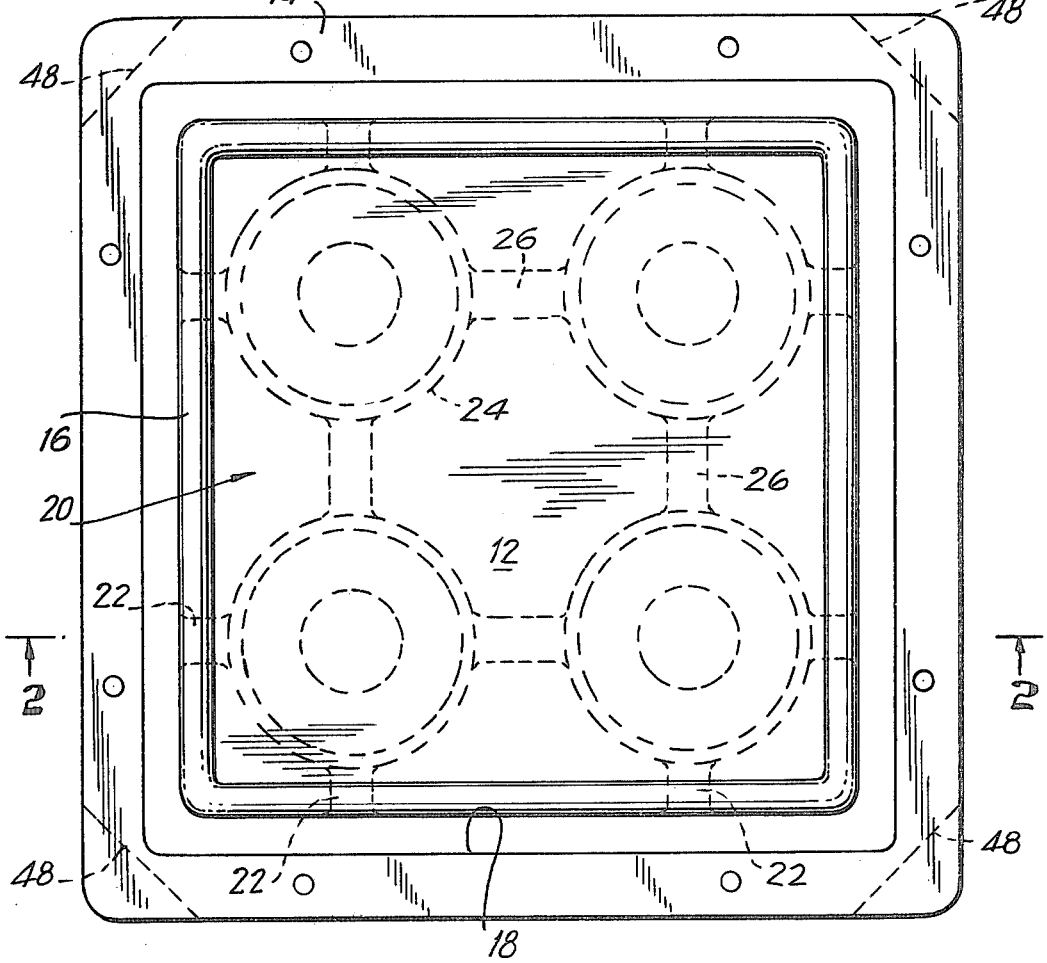
FIG. 1 PRIOR ART
FIG. 1 is a front elevational view of a dynamic speaker of the plane vibrating-plate multi-point drive type according to the prior art.

Referring now to FIG. 1, there is shown generally at 10 a flat plate speaker of the prior art. In such speaker 10, a generally square flat diaphragm 12 is shown to be centered in a frame 14 of similar configuration and is optionally edge supported by a flexible perimeter 16 which holds the flat diaphragm generally centered within a rectangular opening 18 in the frame 14. The flexible perimeter 16 may be made of any convenient material such as paper, plastic or fabric.

A supporting framework 20 behind the flat diaphragm 12 has a plurality of short arms 22 extending from frame 14 and joined in pairs to four support rings 24 symmetrically disposed on diagonals of the flat diaphragm 12. Connecting arms 26 connect together adjacent support rings 24 to form the completed support structure.

The frame 14 and the supporting framework 20 are preferably integrally formed, for example, as by diecasting, of a material which will contribute substantial rigidity to the structure. Suitable materials include aluminum, magnesium, zinc and plastic, however die cast aluminum or magnesium is preferred.

It will be noted from FIG. 1 that the connecting arms 26 constitute a bracing generally in the form of a square box joining together support rings 24 at the apices of the square box.

Figure 2:
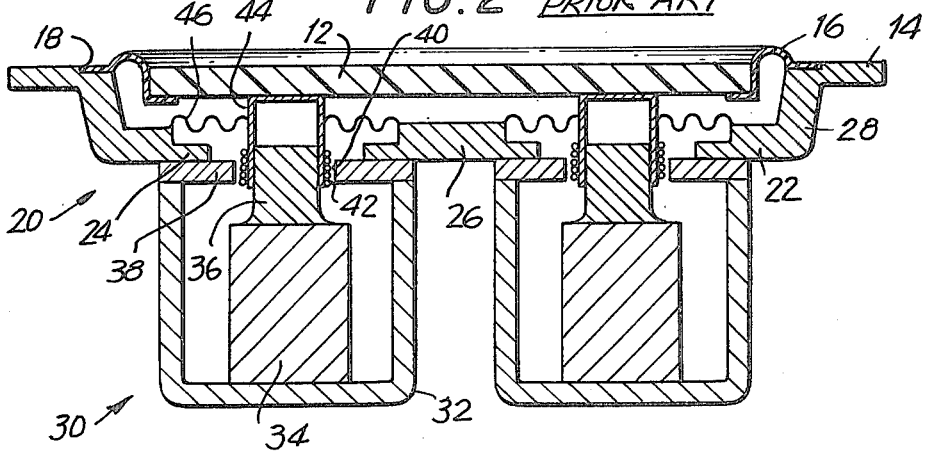
FIG. 2 PRIOR ART
FIG. 2 is a cross-sectional view of the prior art speaker take along the line 2—2 of FIG. 1.

As shown particularly on FIG. 2, the support structure 20 is displaced to the rear of the flat diaphragm 12 by rearwardly directed portions 28 of arms 22 which extend from frame 14.

Magnetic drivers 30 are mounted on support rings 24 by any convenient means (not shown) and each consists of a generally cup-shaped magnetic yoke 32, having centered within it a permanent magnet 34 which, in turn, is physically and magnetically connected to a permeable, generally cylindrical center pole 36. An annular yoke plate 38 substantially closes the inner end of each cup-shaped magnetic yoke 32 and has a centered circular hole 40 into which the center pole 36 extends with radial clearance. A voice coil 42 is wound on a bobbin 44 concentric with the center pole 36 and is situated in the mentioned clearance. The bobbin 44 is connected to the flat diaphragm 12 by any convenient means, such as by cement. A flexible damper member 46 is optionally connected between each bobbin 44 and the supporting framework 20. The flexible damper members 46 maintain the respective bobbins 44 with their voice coils 42 properly centered in the circular holes 40 and avoid rubbing of the voice coils 42 either against the yoke plate 38 or the center poles 36. The flat diaphragm 12 and the attached bobbins 44 and voice coils 42 are thereby enabled to vibrate relatively unrestrained upon flexure of the flexible perimeter 16 and the flexible damper members 46.

It will be noted in FIG. 2 that the magnetic drivers 30 represent relatively large masses supported at their forward ends on supporting framework but free at their rearward ends. With the openness of the supporting framework 20 as best seen in FIG. 1 and with the massive permanent magnets 34 and magnetic yokes 32 supported only at their forward ends from the support rings 24, it has been ascertained that vibration, particularly in rotation about diagonal corner lines, indicated by dashed lines 48 on FIG. 1, occurs at certain frequencies and input levels.

Figure 3:
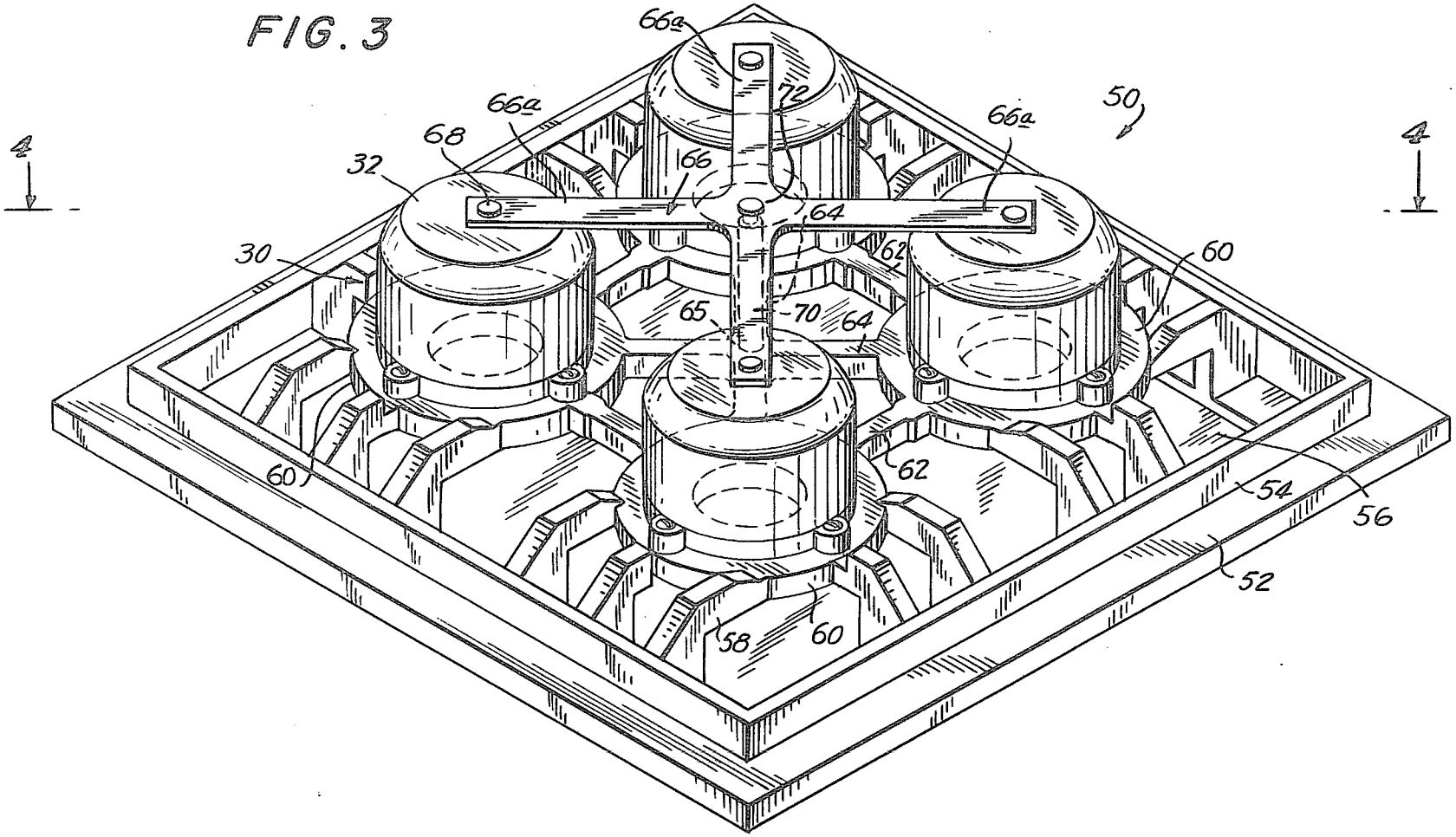
FIG. 3 is a perspective rear view of a speaker according to an embodiment of the prevent invention.

Turning now to FIG. 3, it will be seen that, in an embodiment of a flat-plate dynamic speaker according to the present invention, and which is indicated generally at 50, a frame 52 of generally square shape has a rearward projecting rib 54. The frame 52 continues past the rib 54 to define a generally square opening 56 into which the flat diaphragm (not shown on FIG. 3) is located. Support arms 58, preferably integrally formed with the frame 52 and rib 54, extend rearward and inward over the square opening 56 and, at their inner extremities, are joined to supporting rings 60. Connecting arms 62 connect laterally adjacent support rings 60 together and extend parallel to respective sides of square frame 52. Diagonal connecting arms 64 connect each support ring 60 to its diagonally opposite counterpart. The two diagonal connecting arms 64 cross each other or intersect at a hub 65. The frame 52, rib 54, support arms 58, support rings 60, connecting arms 62, and diagonal connecting arms 64 are preferably integrally formed by any convenient process known in the art but are desirably die cast of metal, such as aluminum or the like. It should be clear to one skilled in the art that other materials and methods of fabrication can be equally applied to the manufacture of speakers according to the present invention.

An X-shaped stiffening brace 66 is arranged with its orthogonally related arms 66*a* extending diagonally of the frame and connected to the diagonally opposite magnetic yokes 32 of the centers of the latter by any convenient means, such as by screws 68. Since the X-shaped stiffening brace 66 and the diagonal connecting arms 64 both lie along diagonals of frame 52, they are therefore relatively aligned with each other at opposite ends of the magnetic drivers 30. A bracing rod 70 connects together the hub 65 of the diagonal connecting arms 64 and the hub 72 of the X-shaped stiffening brace 66.

Figure 4:
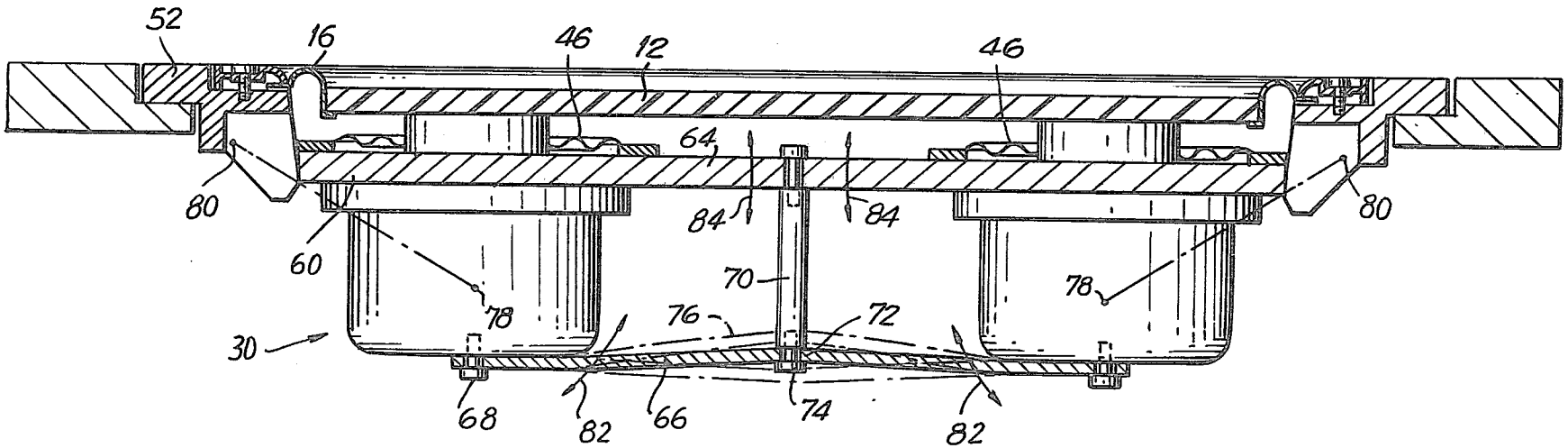
FIG. 4 is an elevational view, in partial cross section along the line 4—4 of FIG. 3.

Turning now to the cross sectional view of FIG. 4 taken along the diagonal of the speaker 50, the bracing rod 70 is shown to be slightly shorter than the undeflected distance between the hub 65 and the hub 72. Therefore, when a screw 74 is installed to attach the hub 72 to bracing rod 70, the center of the X-shaped stiffening brace 66 is deflected toward the diagonal connecting arms 64. Stressing the X-shaped stiffening brace 66 in this way stiffens the entire structure and avoids vibrational motion of the X-shaped stiffening brace 66 in the vibrational modes represented by the chain lines 76 on FIG. 4. Thus, vibrations of the center of mass 78 of each of the magnetic drivers about a fulcrum point 80 in the adjacent corner of the frame 52, as indicated by curved lines 82 adjacent the inner corners of the magnetic drivers 30 and by curved lines 84 about the bases of the magnetic drivers, are substantially attenuated.

The use of the X-shaped stiffening brace 66 and the diagonal connecting arms 64 in the manner previously described permits reduction in thickness of the support arms 58 and connecting arms 62 sufficiently to achieve an openness at the rear of the flat diaphragm 12 exceeding 60 percent without suffering the vibration which would otherwise occur through such reduction in thickness.

As can be appreciated from the application of elementary principles of mechanics to the structure shown in FIG. 4, the maximum amplitude of vibration occurs along curved lines 84 adjacent the base of the magnetic drivers 30. The diagonal connecting arms 64 oppose the vibration of such location and translate a substantial portion of any vibration along curved lines 84 into substantially damped linear vibrations along the axis of the diagonal connecting arms 64. Such linear vibrations are not significant in the degradation of acoustic performance.

A mass of material, different from the material of the X-shaped stiffening brace 66 may be laminated thereto in order to depress the frequency at which the X-shaped stiffening brace 66 may vibrate. Any suitable material such as lead, rubber or plastic may be used for this purpose.

The described speaker 50 is shown to be square and to have four drivers 30, but it will be apparent to one skilled in the art, upon reading the present disclosure, that more or less than four magnetic drivers 30 may be employed in a symmetrical arrangement. For example, a triad of magnetic drivers 30 at the apices of an equilateral triangle or five magnetic drivers at the apices of a pentagon, etc., may be employed without departing from the present invention. When the arrangement of the magnetic drivers is changed, the element described as an X-shaped stiffening brace 66 in the illustrated embodiment of the present invention, would of course, be modified to suit the new arrangement. In addition, the bracing rod 70 which is shown as a separately fabricated and installed element could equally be made unitary with the diagonal connecting arms 64 or the X-shaped stiffening brace 66 and connected at the outboard end thereof to the other element. Furthermore, although only a single bracing rod 70 is shown connecting together the diagonal connecting arms 64 and X-shaped stiffening brace 66, additional connections may be employed without departing from the present invention. For example, diagonal bracing may also be employed without or with the bracing rod 70 to produce a truss (not shown) for additional stiffening of the structure.

It will be understood that the claims are intended to cover all changes and modifications of the preferred embodiments of the invention, herein chosen for the purpose of illustration which do not constitute departures from the spirit and scope of the invention.

What is claimed is:

1. A loudspeaker comprising:
a frame having an opening therein;
a substantially flat diaphragm disposed within said opening;
a plurality of support arms connected to said frame;
a plurality of symmetrically arranged magnetic drivers disposed behind said diaphragm and each supported at its forward end by said support arms;
electro-magnetic coupling means between said magnetic drivers and similarly symmetrically arranged locations on the rear surface of said flat diaphragm; and
at least one stiffening brace means between the rearward end of one of said magnetic drivers and the rearward end of another of said drivers.

2. The loudspeaker as set forth in claim 1, wherein:
said opening and said flat diaphragm are square;
said plurality of magnetic drivers comprises four magnetic drivers;
said four magnetic drivers are located along diagonals of said flat diaphragm;
diagonal connecting arms connect together the forward ends of all four magnetic drivers; and
said at least one stiffening brace means for four arms disposed parallel to diagonals of said flat diaphragm, and the ends of said four arms are connected to the rearward ends of said four magnetic drivers, respectively.

3. The loudspeaker as set forth in claim 2, further comprising a bracing element disposed normal to said flat diaphragm and connecting the centers of said diagonal connecting arms and of said at least one stiffening brace means.

4. The loudspeaker as set forth in claim 3, wherein said bracing element is shorter than the perpendicular distance between the centers of said diagonal connecting arms and said at least one stiffening brace means whereby said bracing element is placed in tension.

5. A flat-plate loudspeaker comprising:
a substantially flat diaphragm having a front surface and a rear surface;
a frame surrounding the perimeter of said diaphragm;
a plurality of spaced apart magnetic drivers magnetically connected to said rear surface;
support means connected to said frame for supporting said magnetic drivers at the ends thereof nearer said rear surface; and
stiffening means connecting together at least two of said magnetic drivers at the ends thereof remote from said rear surface.

6. The loudspeaker as set forth in claim 5, wherein said frame, magnetic drivers, support means and stiffening means define an openness facing said rear surface which is at least 60 percent of the area of said diaphragm.

7. The loudspeaker as set forth in claim 5, wherein said support means includes:
a plurality of support arms attached to said frame;
a plurality of support rings attached to said support arms and aligned respectively with the first mentioned ends of said magnetic drivers; and
connecting arms connecting adjacent support rings together.

8. The loudspeaker as set forth in claim 7, in which said diaphragm is square;
said plurality of support rings and magnetic drivers are four each symmetrically disposed along diagonals of said square;
said connecting arms extend diagonally and connect diagonally opposed support rings; and
said stiffening means is an X-shaped stiffening brace.

9. The loudspeaker as set forth in claim 8, wherein said X-shaped stiffening brace has angularly related arms which, at their ends, are connected to the centers of said magnetic drivers.

10. The loudspeaker as set forth in claim 5, further comprising at least one bracing element connecting together said support means and said stiffening means.

11. A plane vibrating-plate, multi-point drive dynamic speaker comprising:
a square diaphragm;
a frame substantially co-planar with said diaphragm having a square opening therein larger than said diaphragm;
four spaced apart magnetic drivers symmetrically disposed along two diagonals of said square diaphragm;
a plurality of support arms connected to said frame and supporting the ends of said magnetic drivers nearer to said diaphragm;
connecting arms disposed parallel to the sides of said square opening and connecting adjacent magnetic drivers together;
four diagonal connecting arms connecting together said ends of the diagonally opposed pairs of said magnetic drivers; and
an X-shaped stiffening brace having arms lying along diagonals of said diaphragm and connecting together the ends of said magnetic drivers further from said diaphragm;
said magnetic drivers, said support connecting and diagonal connecting arms and said stiffening brace occupying less than 40 percent of the area facing said diaphragm.

* * * * *